US008242682B2

(12) United States Patent
Toyoguchi

(10) Patent No.: US 8,242,682 B2
(45) Date of Patent: Aug. 14, 2012

(54) LIGHT EMITTING SCREEN AND METHOD OF FABRICATING THE LIGHT EMITTING SCREEN

(75) Inventor: Ginjiro Toyoguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/158,535

(22) Filed: Jun. 13, 2011

(65) Prior Publication Data

US 2012/0007491 A1 Jan. 12, 2012

(30) Foreign Application Priority Data

Jul. 9, 2010 (JP) ..... 2010-156929

(51) Int. Cl.
*H01J 9/00* (2006.01)

(52) U.S. Cl. ..... 313/496; 313/497; 313/495; 445/24

(58) Field of Classification Search ..... 313/414, 313/441–460, 495–497, 293–304, 306, 309–310, 313/346, 351, 355; 438/20
See application file for complete search history.

(56) References Cited

U.S. PATENT DOCUMENTS 6,677,706 B1 1/2004 Hara et al.
7,492,087 B2 2/2009 Hara et al.
7,791,264 B2 9/2010 Hara et al.
7,812,514 B2 10/2010 Kojima et al.
8,018,133 B2 9/2011 Ibuki et al.
2005/0276096 A1 12/2005 Hara et al.
2007/0241656 A1 10/2007 Hara et al.
2008/0174232 A1 7/2008 Ibuki et al.

FOREIGN PATENT DOCUMENTS

JP 2008-181867 8/2008
JP 10-326583 12/2011

*Primary Examiner* — Mariceli Santiago
*Assistant Examiner* — Donald Raleigh
(74) *Attorney, Agent, or Firm* — Fitzpatrick, Cella, Harper & Scinto

(57) ABSTRACT

A method of fabricating a light emitting screen 1 comprises steps of providing a resistance layer 6 having a plurality of apertures arranged in a lattice pattern and having light emitting members each arranged in each of the apertures, on a substrate 2 having an image display region 10 and a peripheral region 11 at an outer periphery of the image display region, such that the resistance layer extends from the image display region to the peripheral region, and such that the plurality of apertures are arranged in the image display region, providing a resistance adjusting layer having a resistance value larger than that of the resistance layer, on the resistance layer, to divide the image display region and the peripheral region into a plurality of segments, and forming a film of an electroconductive layer to cover the resistance layer and the light emitting member positioned in the segments.

7 Claims, 6 Drawing Sheets

LIGHT EMITTING SCREEN AND METHOD OF FABRICATING THE LIGHT EMITTING SCREEN

BACKGROUND OF THE INVENTION

1. Field of the Invention

The present invention relates to a light emitting screen for use in an image display apparatus and a method of fabricating the light emitting screen. In particular, the present invention relates to a light emitting screen having a light emitting member which displays an image by emitting light by irradiation of an electron beam emitted from an electron-emitting device, and a method of fabricating the light emitting screen.

2. Description of the Related Art

The image display apparatus using the electron-emitting device accelerates the electron beam by applying a voltage several-kV higher than that of the electron-emitting device to a phosphor surface. Unfortunately, the distance between the phosphor surface and the electron-emitting device is about 1 to 2 mm, and thus an intense electric field is formed. The intense electric field often causes discharge. In order to restrict current from flowing when a discharge occurs, Japanese Patent Application Laid-Open No. H10-326583 discloses a structure in which an anode formed on the phosphor surface is divided into several anodes, each of which is connected to each other with a resistance member interposed therebetween. In addition, Japanese Patent Application Laid-Open No. 2008-181867 discloses another structure in which mutually divided anodes are electrically connected to each other with a specific shaped resistance member interposed therebetween on a peripheral region outside an image display region. Specifically, a thin resistance member with a specific shape is interposed between each adjacent anode and the anodes are electrically connected to each other.

The image display region of the light emitting screen constituting the image display apparatus has anodes. In order to surely form anodes in the image display region, anodes generally may also be formed in the peripheral region outside the image display region.

Conventionally, for the purpose of antistatic treatment, the anodes on the peripheral region outside the image display region are electrically connected to the anodes on the image display region each with a resistance member interposed therebetween. In addition, the mutually divided anodes on the peripheral region are also electrically connected to each other with a resistance member interposed therebetween. Unfortunately, the present inventors have made zealous studies paying attention to the structure disclosed in Japanese Patent Application Laid-Open No. H10-326583 and have found that disconnection tends to occur in a connection between an anode and a resistance member interposed therebetween and the anodes in the peripheral region tends to be charged. Further unfortunately, the present inventors have also made zealous studies paying attention to the structure disclosed in Japanese Patent Application Laid-Open No. 2008-181867 and have found that each anode in the peripheral region of the light emitting screen has a large electric capacitance, and thus tends to be greatly damaged by discharging. The present invention has an object to provide a light emitting screen which can suppress discharge in a peripheral region of the light emitting screen and can improve electrical connection between the anodes and a method of fabricating the same.

SUMMARY OF THE INVENTION

A method of manufacturing a light emitting screen according to one aspect of the present invention comprises: a first step for providing a resistance layer having a plurality of apertures arranged in a lattice pattern and having light emitting members each arranged in each of the apertures, on a substrate having an image display region and a peripheral region at an outer periphery of the image display region, such that the resistance layer extends from the image display region to the peripheral region, and such that the plurality of apertures are arranged in the image display region; a second step for providing a resistance adjusting layer having a resistance value larger than that of the resistance layer, on the resistance layer, to divide the image display region and the peripheral region into a plurality of segments; and a third step for forming a film of an electroconductive layer to cover the resistance layer and the light emitting member positioned in the segments.

A light emitting screen according to the other aspect of the present invention comprises: a substrate having an image display region and a peripheral region at an outer periphery of the image display region; a resistance layer having a plurality of apertures arranged in a lattice pattern in the image display region, and extending from the image display region to the peripheral region on the substrate; light emitting members each arranged in each of the apertures; a resistance adjusting layer having a resistance value larger than that of the resistance layer, on the resistance layer, to divide the image display region and the peripheral region into a plurality of segments; and an electroconductive layer to cover the resistance layer positioned in the segments.

The present invention can suppress discharge in the peripheral region of the light emitting screen and can improve electrical connection between the anodes.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings. Now, embodiments of the present invention will be described. The present invention can be applied to a light emitting screen for use in an image display apparatus such as an electron beam display apparatus and a plasma display apparatus such as a CRT (Cathode Ray Tube) and an FED (Field Emission Display). In particular, examples of a light emitting screen for cathode-luminescent operation include a light emitting screen having anodes made of phosphor and metal thin films formed on a transparent glass substrate, which is applied to the FED and to which the present invention is preferably applied.

Of the FED, the embodiments of the present invention focus particularly on a surface-conduction electron-emitter display (SED) apparatus using a surface-conduction electron-emitting device which will be described specifically using the accompanying drawings.

First Embodiment

Figure 3:
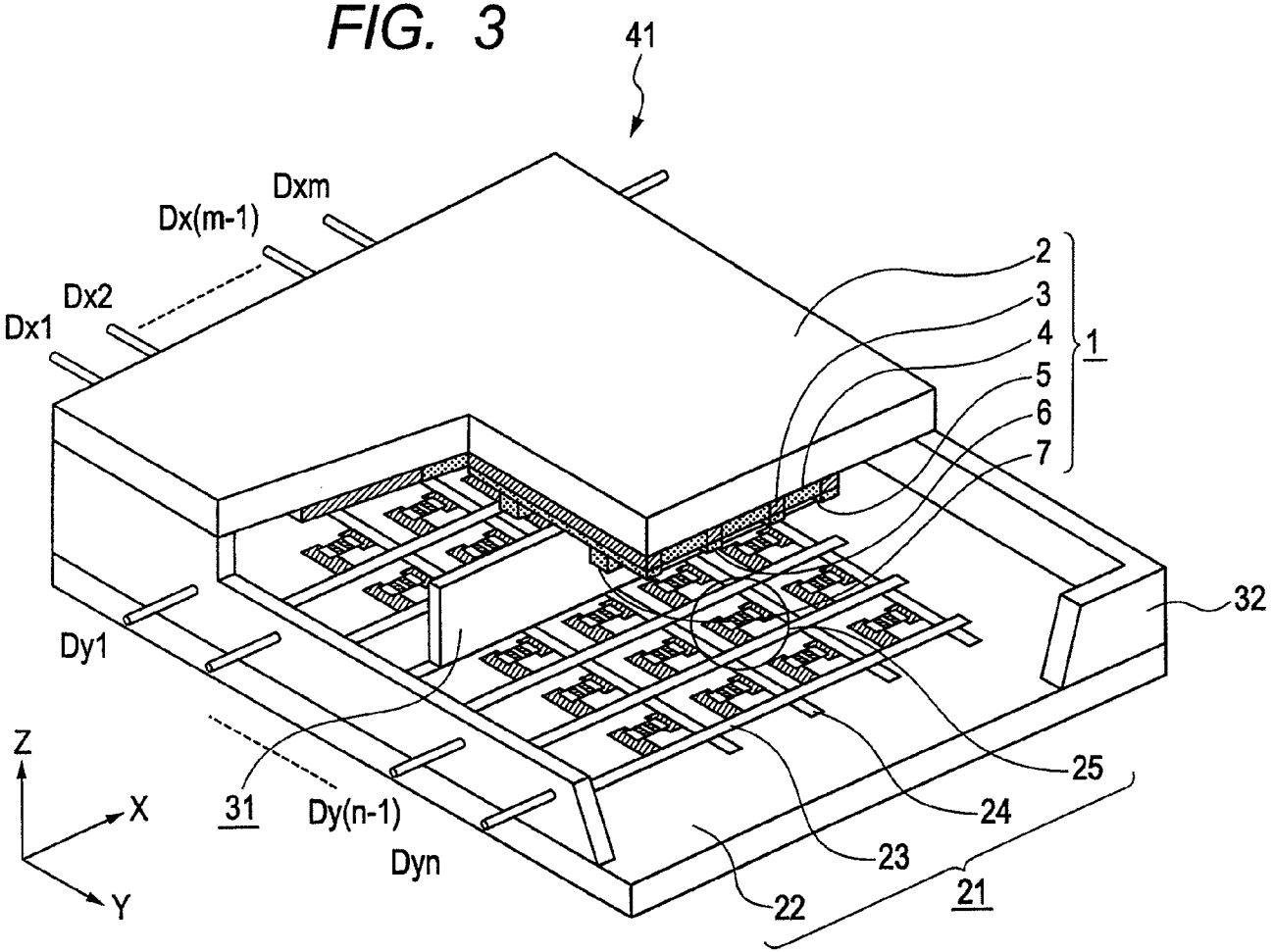
FIG. 3 is a partially broken perspective view of an image display apparatus having the light emitting screen according to the first embodiment of the present invention.

FIG. 3 is a partially broken perspective view illustrating a basic configuration of an image display apparatus 41 according to a first embodiment of the present invention. The image display apparatus 41 has a rear plate 21 having a plurality of surface-conduction electron-emitting devices 25 arranged in a two-dimensional lattice pattern and a face plate 1 as a light emitting screen located opposite to the rear plate 21. The face plate 1 and the rear plate 21 together with an outer frame 32 form a vacuum chamber. The inside of the vacuum chamber includes a spacer 31 located between the rear plate 21 and the face plate 1 and alternately supporting the rear plate 21 and the face plate 1. For the purpose of antistatic treatment, the spacer 31 is made of a high resistance member capable of flowing a small amount of current. The vacuum chamber further includes a power supply, a drive circuit, and the like (unillustrated) to constitute the image display apparatus 41.

The rear plate 21 includes: a substrate 22; a scanning wiring 23 and a signal wiring 24 formed on the substrate 22; and a surface-conduction electron-emitting device 25. The scanning wiring 23 includes an N number of scanning wirings and the signal wiring 24 includes an M number of signal wirings. The surface-conduction electron-emitting device 25 includes N×M matrices of surface-conduction electron-emitting devices. N and M are a positive integer and are appropriately set according to the intended number of display pixels. For example, in the case of FHD (Full High Definition), N and M are set such as N=1080 and M=1920×3=5760.

Figure 2A:
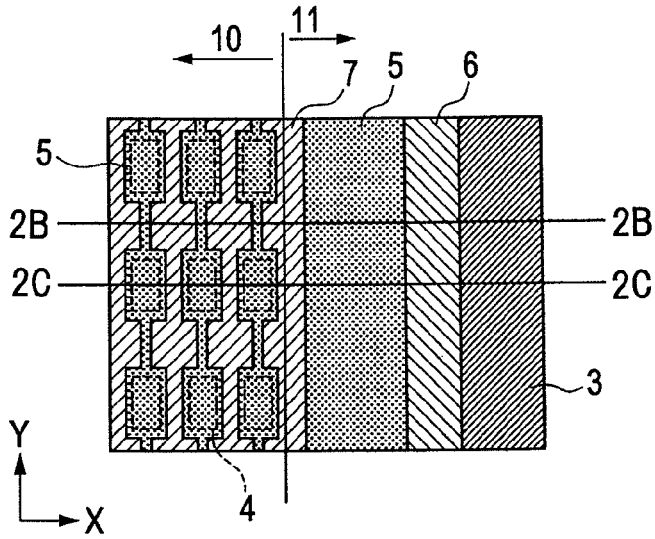
FIGS. 2A, 2B and 2C are partially enlarged views of the light emitting screen according to the first embodiment of the present invention.
Figure 2B:
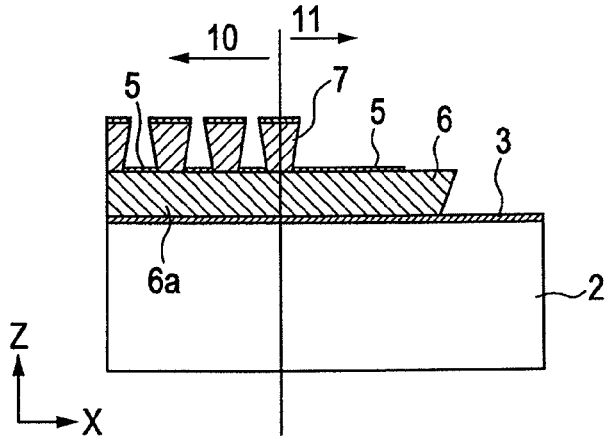
Figure 2C:
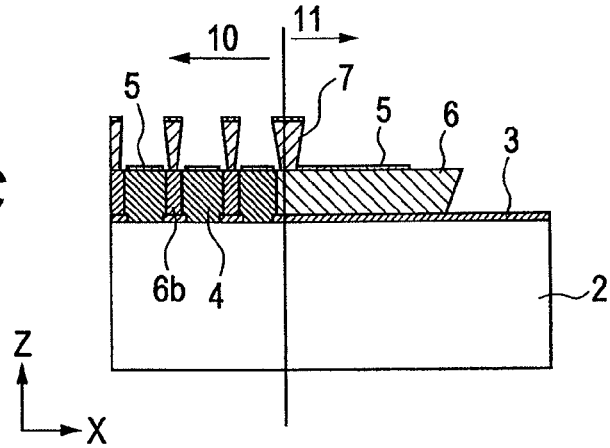
Figure 4:
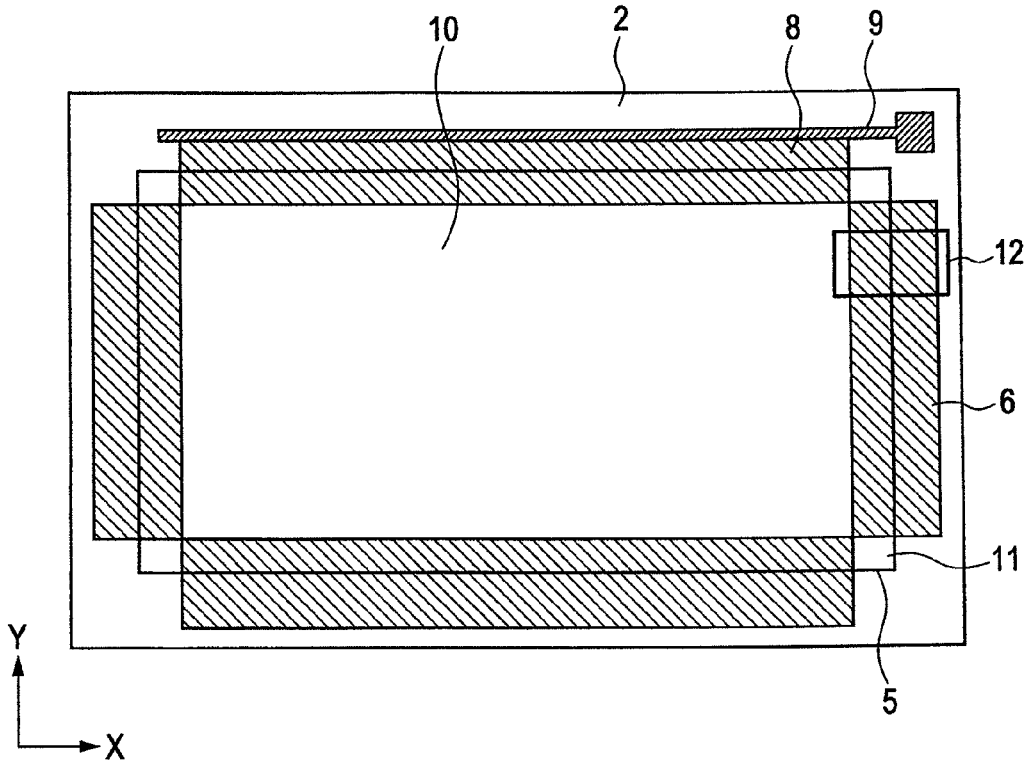
FIG. 4 is a plan view illustrating a basic configuration of the light emitting screen according to the first embodiment of the present invention.

FIG. 4 is a plan view illustrating a basic configuration of the face plate 1 as the light emitting screen. In FIG. 4, the structure inside the image display region 10 is omitted. FIGS. 2A to 2C are enlarged plan views of a region 12 illustrated in FIG. 4. FIG. 2A is a plan view of the region 12. FIG. 2B is a sectional view along line 2B-2B of FIG. 2A. FIG. 2C is a sectional view along line 2C-2C of FIG. 2A. The face plate 1 has an image display region 10 which includes a phosphor layer, divided anodes 5, and resistance layers 6, through which the divided anodes 5 are electrically connected to each other. The face plate 1 further has a common electrode 9 located along one end of the image display region 10 and supplying an anode potential to the anodes 5 of the image display region 10. The anodes 5 of the image display region 10 and the common electrode 9 are connected to each other through connection resistances 8. The face plate 1 further has a peripheral region 11 interposed between the image display region 10 and the common electrode 9. The anodes 5 and the resistance layers 6 are also formed on the peripheral region 11. The peripheral region 11 outside the image display region 10 is formed so as to surround the outer periphery of the image display region 10 and the boundary is located on an outer periphery of pixels contributing display.

Now, by referring to FIGS. 2A to 2C, the structure of the face plate 1 as the light emitting screen will be described in detail. The face plate 1 has a substrate 2. The substrate 2 can be made of glass in terms of maintaining vacuum and strength, preferably high strain point glass.

The substrate 2 has a black matrix 3 thereon. The black matrix 3 has a resistance value higher than and preferably about 100 times or higher than that of the resistance layer 6 as described later. The black matrix 3 has a plurality of apertures in the image display region 10. Each aperture has a light emitting member 4 made of phosphors such as red (R), green (G), and blue (B).

According to present embodiment, the resistance layer 6 is formed on and in contact with the black matrix 3 on the substrate 2. The resistance layer 6 is formed into a step shape (so called reverse taper shape) such that an end surface in a direction of projecting from the substrate 2 has an area larger than that of the other end surface facing the side of the substrate 2. This step shape allows the anode 5 later subjected to film formation to be divided into several portions. Note that the resistance layer 6 can have a thickness of 10 μm or more so as to surely allow the step shape to divide the anode 5 into several portions. The resistance layer 6 has a plurality of horizontal line portions 6*a* extending in the X direction between the light emitting members 4; and a plurality of vertical line portions 6*b* extending in the Y direction between the light emitting members 4 in the image display region 10, both portions being formed in mesh (see FIGS. 2B and 2C). The light emitting members 4 are arranged in the X direction in the order of R, G, and B. Accordingly, the vertical line portion 6*b* is narrower in width than the horizontal line portion 6*a*. For example, the vertical line portion 6*b* is 30 to 100 μm wide, while the horizontal line portion 6*a* is 150 to 390 μm wide. Further, the resistance layer 6 is also formed in the peripheral region 11 outside the image display region 10. According to the present embodiment, the resistance layer 6 is uniformly formed in the peripheral region 11. The resistance layer 6 is formed in the image display region 10 and the peripheral region 11 so as to extend beyond and outside the region of the anodes 5 which are formed later than the resistance layer 6. Note that in a step of forming the anode 5, the resistance layer 6 can be formed in a region 1 mm or more larger than the region of the anode 5 in consideration of film intrusion and mask position accuracy. Note also that the resistance layer 6 can be integrally formed into a pattern extending without being divided in the X and Y directions. Note also that a precursor pattern of the resistance layer 6 can be formed by photolithography using a photo paste with metal fine particles dispersed in a glass matrix.

Further, a resistance adjusting layer 7 is provided on the resistance layer 6. The resistance adjusting layer 7 is provided on and along the vertical line portion 6*b* of the resistance layer 6 in the image display region 10. The resistance adjusting layer 7 is wider in a position where the horizontal line portion 6*a* and the vertical line portion 6*b* of the resistance layer 6 are crossed. According to the present embodiment, the resistance adjusting layer 7 is also provided at the boundary between the image display region 10 and the peripheral region 11, but the resistance adjusting layer 7 is not provided in the peripheral region outside thereof. The resistance adjusting layer 7 is placed on the resistance layer 6, and the resistance layer 6 functions as a current path between the divided anodes 5. In order to allow the resistance layer 6 to exert the function, the resistance adjusting layer 7 can have a resistance value higher than and preferably about 100 times or higher than that of the resistance layer 6. The resistance adjusting layer 7 is formed into a step shape (reverse taper shape) such that an front end surface in a direction of projecting from the substrate 2 has an area larger than that of the other end surface contacting resistance layer 6. Like the resistance layer 6, the step shape allows the anode 5 later subjected to film formation to be divided into several portions. Note that the resistance adjusting layer 7 can have a thickness of 10 μm or more so as to surely allow the step shape to divide the anode 5 into several anodes. Note also that in order to form the resistance adjusting layer 7, first, the method of forming a precursor pattern of the resistance adjusting layer 7 can be used by photolithography using a photo paste in a glass matrix. In this case, the resistance adjusting layer 7 is formed by firing the glass matrix at a temperature required to sinter the glass matrix. Note that at this time, the resistance layer 6 can be formed by firing the aforementioned precursor pattern of the resistance layer 6 at the same time.

The substrate 2 has the anode 5 thereon. In the image display region 10, the anode 5 is divided into a plurality of regions by the resistance adjusting layer 7. Each of the divided anodes 5 covers at least one light emitting member 4. According to the present embodiment, the anodes 5 are formed along the Y direction and divided in the X direction. Each anode 5 is electrically connected to each other in the Y direction by the resistance layer 6 located as a lower layer of the regions divided by the resistance adjusting layer 7. In the peripheral region 11, the anode 5 is uniformly provided on the resistance layer such that the outer edge of the anode 5 is located inside the outer edge of the resistance layer 6. The value of the resistance formed by the resistance layer 6 and the resistance adjusting layer 7 can be $1\times10^{-1}$ Ω/sq or more in terms of discharge current suppression effects. Meanwhile, an excessively high resistance value causes a remarkable reduction in luminance of a display image, and thus the resistance value can be equal to or less than $1\times10^{8}$ Ω/sq. The configuration of forming the resistance layer 6 under the anode 5 deposited in the peripheral region 11 of the face plate 1 eliminates the electrical connections between the anode 5 and the resistance layer 6 in the X and Y directions in the figure. The anode 5 can be formed by a vacuum film formation such as depositing and sputtering metal such as aluminum. Note that in FIG. 2A, in order to illustrate pattern shapes, the anode on the resistance adjusting layer 7 is not illustrated (the same is applied to FIGS. 5A and 6A described later).

By referring to FIG. 3, the anode 5 is electrically connected to a high voltage terminal in the vacuum chamber through the common electrode 9 and the connection resistance 8. A high voltage of about 1 kV to 15 kV is applied to the anode 5 from an unillustrated high voltage power supply. Each of the scanning wiring 23 and the signal wiring 24 is electrically connected to terminals Dyn (n is 1 to N) and Dxm (m is 1 to M) respectively in the vacuum chamber, and receives a scan signal and an image signal respectively from an unillustrated drive circuit. The electron-emitting device 25 emits an electron according to the signal. The electron is attracted to the potential of the anode 5 and passes through the anode 5 to cause a phosphor of the light emitting member 4 to emit light. The luminance can be adjusted by the voltage and the signal.

According to the present invention, the resistance layer 6 is formed to extend to a region larger than the anode 5 in a layer under the anode 5 in the peripheral region 11 of the face plate 1. In particular, the resistance layer 6 extends from the image display region 10 through to the peripheral region 11 on the substrate 2. This structure reduces the possibility of disconnection between the anode 5 and the resistance layer 6.

When an image is displayed, the electrons emitted from the electron-emitting device 25 are not directly incident on the peripheral region 11 of the face plate 1, but the electrons scattered from the electrons incident on light emitting member 4 may be incident on the peripheral region 11. If the anode 5 of the peripheral region 11 is not electrically connected to the image display region 10, the scattered electrons cause the anode 5 of the peripheral region 11 to be charged, leading to abnormal discharge. According to the present invention, the resistance layer 6 is formed in a layer under the anode 5 in a region of the peripheral region 11 of the face plate 1 so as to extend from the image display region 10. This structure can improve electrical connection between the anode 5 and the resistance layer 6, as well as electrical connection between the anodes 5. Thus, the present invention can provide a more reliable electrical connection between the image display region 10 and the peripheral region 11 and can prevent charge in the peripheral region 11 and can suppress abnormal discharge.

Now, by referring to FIGS. 1A to 1F, a method of fabricating the face plate 1 as the light emitting screen will be described. FIGS. 1A to 1F are process views illustrating a method of fabricating the light emitting screen, and more specifically, illustrating the region 12 of FIG. 4, namely, a portion corresponding to the region illustrated in FIGS. 2A to 2C.

As a first step, an image display region 10 and a peripheral region 11 are formed on the substrate 2. Then, regions for displaying images are formed in the image display region 10. Then, a resistance layer 6 having a plurality of apertures formed in a lattice pattern and having light emitting members 4 therein is formed on the substrate 2. The resistance layer 6 extends from the image display region 10 through to the peripheral region 11, and the plurality of apertures are located at least in the image display region 10. More specifically, first, the substrate 2 is prepared (see FIG. 1A). Then, a black matrix 3 with a predetermined pattern is applied to the substrate 2 as needed (see FIG. 1B). Then, the resistance layer 6 having a plurality of apertures arranged in a lattice pattern at least in the image display region 10 is formed on the substrate 2 so as to extends from the image display region 10 through to the peripheral region 11 (see FIG. 1C). According to the present embodiment, the resistance layer 6 has a uniform pattern in the peripheral region 11. Then, a plurality of light emitting members 4 is formed in the plurality of apertures of the resistance layer 6 (see FIG. 1D).

Figure 1A:
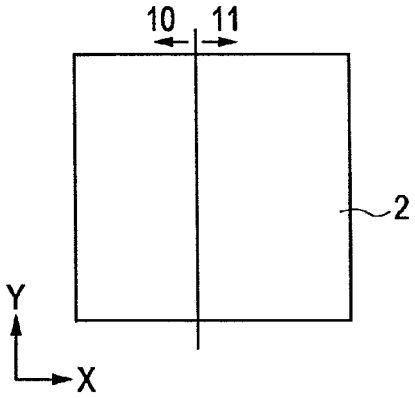
FIGS. 1A, 1B, 1C, 1D, 1E and 1F are process views illustrating a method of fabricating a light emitting screen according to a first embodiment of the present invention.
Figure 1B:
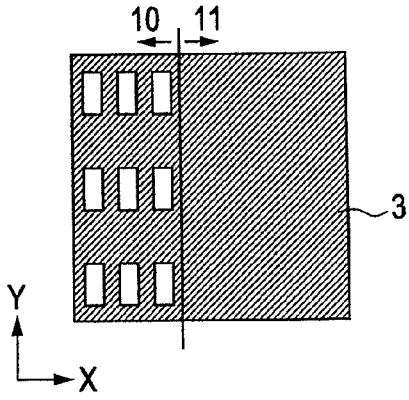
Figure 1C:
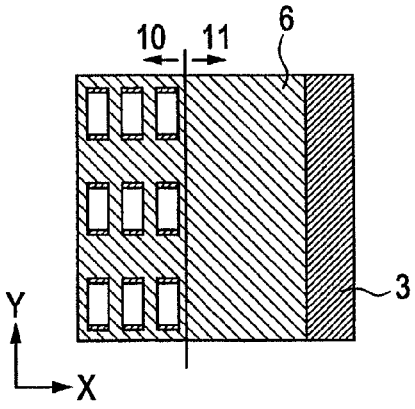
Figure 1D:
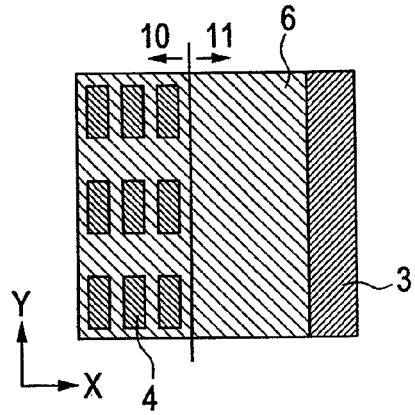
Figure 1E:
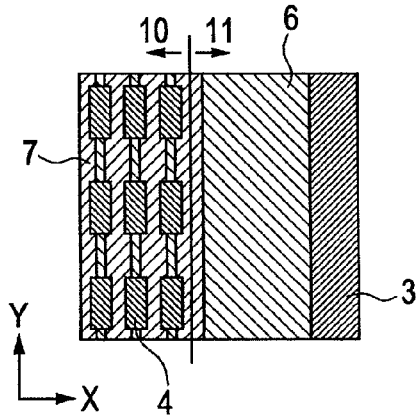

Then, as a second step, a resistance adjusting layer 7 having a resistance value higher than that of the resistance layer 6 is formed on the resistance layer so as to divide the entire region of the image display region 10 and the peripheral region 11 into a plurality of regions (see FIG. 1E).

Figure 1F:
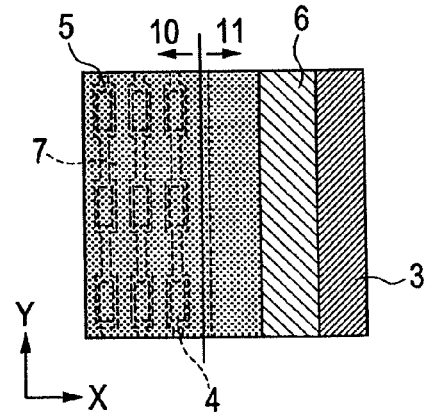

Then, as a third step, anodes 5 are formed in a region inside the outer edge of the resistance layer 6 so as to cover the resistance layer 6 and the light emitting member 4 within a region divided by the resistance adjusting layer 7 (see FIG. 1F). For example, depositing or sputtering is used to form the anodes 5 in an entire region inside the outer edge of the resistance layer 6 on the substrate 2. At this time, as described above, the anode 5 is divided into a plurality of portions by the step shape of the resistance adjusting layer 7. The anode 5 is also formed on the light emitting member 4 in the image display region 10. Thus, the aforementioned light emitting screen is fabricated.

Second Embodiment

Figure 5A:
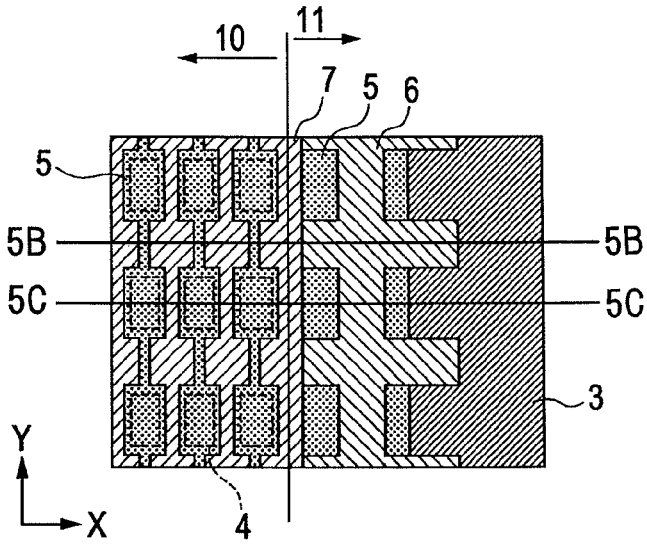
FIGS. 5A, 5B and 5C are partially enlarged views of a light emitting screen of a second embodiment of the present invention.
Figure 5B:
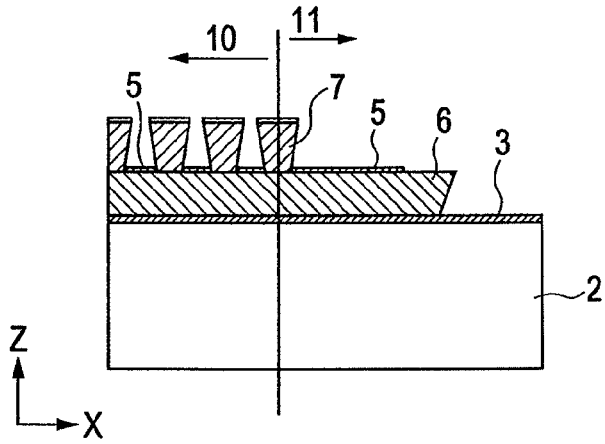
Figure 5C:
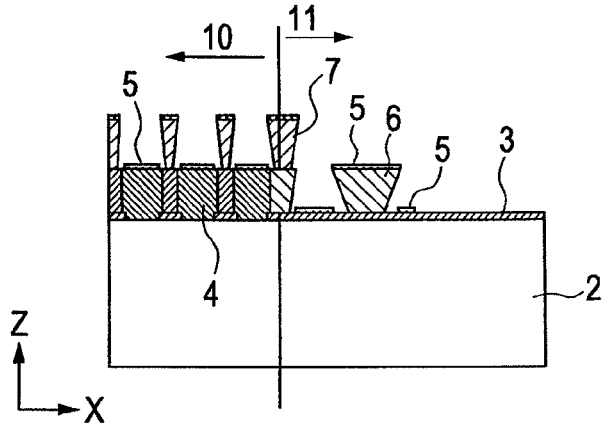

FIGS. 5A to 5C are partially enlarged plan views of the light emitting screen according to a second embodiment of the present invention and more specifically, illustrates a portion corresponding to the region 12 illustrated in FIG. 4. FIG. 5A is a partially enlarged plan view of the light emitting screen. FIG. 5B is a sectional view along line 5B-5B of FIG. 5A. FIG. 5C is a sectional view along line 5C-5C of FIG. 5A.

The present embodiment is the same as the first embodiment except that the face plate 1 as the light emitting screen has a different configuration of the peripheral region 11. In the first embodiment, the resistance layer 6 in the peripheral region 11 is uniformly formed (solid pattern), while in the present embodiment, the resistance layer 6 in the peripheral region 11 has a plurality of apertures formed in a lattice pattern (see FIG. 5A). The anodes 5 are formed on the resistance layer 6 and in the plurality of apertures. Each anode 5 in the peripheral region 11 is divided into a plurality of portions by the step shape of the resistance layer 6. Accordingly, this structure of the peripheral region 11 can reduce the capacitance of each anode 5 which may contribute to discharge and as a result, can suppress discharge current. In this structure, the anode 5 formed in an aperture of the resistance layer 6 is disconnected from the resistance layer 6, but each anode 5 can be divided into a sufficiently small size to minimize charge effects as much as possible. The size of each divided anode 5 is preferably 1 to 4 pixels and more preferably 1 to 2 pixels from the point of view of suppressing discharge current. Note that the anode 5 in the resistance layer 6 of the peripheral region 11 is electrically connected to the anode 5 in the image display region 10 in the same manner as in the first embodiment.

The method of fabricating the light emitting screen according to the second embodiment is substantially the same as the fabrication method described in the first embodiment except that in the aforementioned first step, the resistance layer 6 is formed such that the peripheral region 11 also has a plurality of apertures. Accordingly, when the anode 5 is formed in the aforementioned third step, the anode 5 is formed not only in the aperture of the resistance layer 6 but also on the resistance layer 6 in the peripheral region 11.

Third Embodiment

Figure 6A:
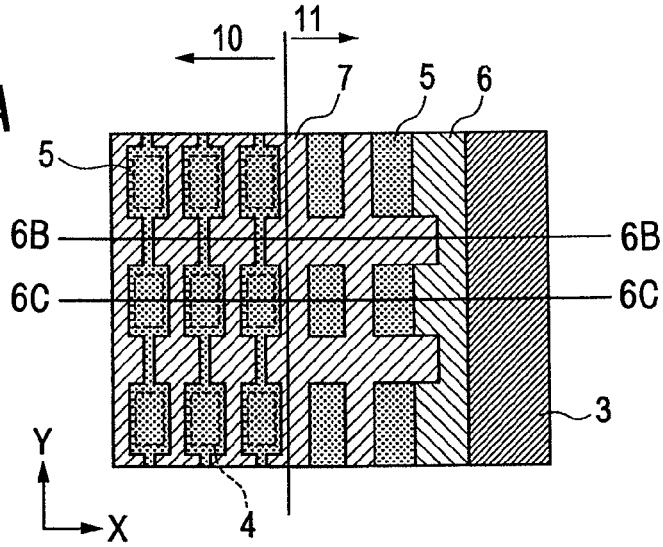
FIGS. 6A, 6B and 6C are partially enlarged views of a light emitting screen of a third embodiment of the present invention.
Figure 6B:
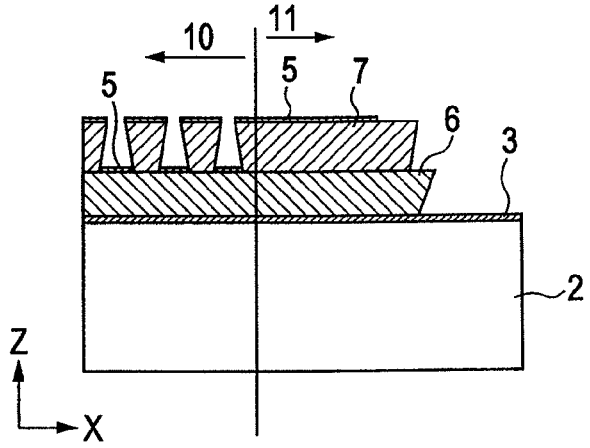
Figure 6C:
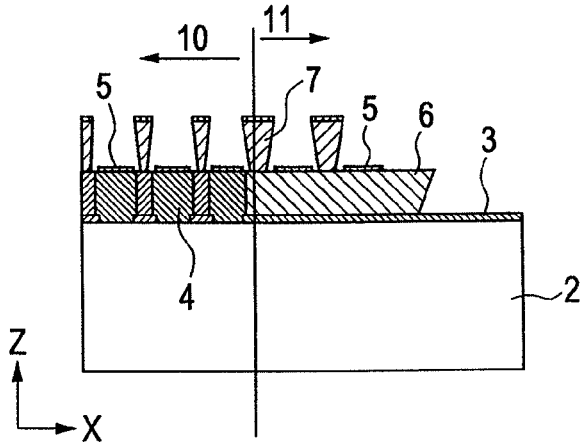

FIGS. 6A to 6C are partially enlarged plan views of the light emitting screen according to a third embodiment of the present invention and more specifically, illustrates a portion corresponding to the region 12 illustrated in FIG. 4. FIG. 6A is a plan view of the portion of the light emitting screen. FIG. 6B is a sectional view along line 6B-6B of FIG. 6A. FIG. 6C is a sectional view along line 6C-6C of FIG. 6A.

The present embodiment is the same as the first embodiment except that the resistance adjusting layer 7 is also formed in the peripheral region 11 outside the image display region 10.

The resistance adjusting layer 7 is formed so as to divide the peripheral region 11 into a plurality of regions. Each anode 5 is formed on the resistance layer 6 in a region divided by the resistance adjusting layer 7. The structure in which the anode 5 in the peripheral region 11 is divided into a plurality of portions may be the same as the divided region formed in the second embodiment (see FIG. 6A). In comparison with the first embodiment, the present embodiment is configured such that electrical connection between anodes 5 is perform in the resistance layer 6 and disconnection between anodes 5 is perform in the resistance adjusting layer 7. The anodes 5 disconnected in the resistance adjusting layer 7 are electrically connected in the resistance layer 6 located under the resistance adjusting layer 7. As a result, in comparison with the second embodiment, this structure can improve electrical connection between divided anodes 5 and can further suppress discharge current.

The method of fabricating the light emitting screen according to the third embodiment is substantially the same as the fabrication method described in the first embodiment except that in the aforementioned second step, the resistance adjusting layer 7 is formed such that the peripheral region 11 is divided into a plurality of regions. Accordingly, when the anode 5 is formed in the aforementioned third step, the anode 5 is also formed on the resistance layer 6 in a region divided in the resistance adjusting layer 7.

Example 1

Now, based on FIGS. 1A to 1F and FIGS. 2A to 2C, examples will be described.

In the first example, PD-200 manufactured by Asahi Glass Co. Ltd., was used as the substrate 2. A black photo paste (NP-7811M1 manufactured by Noritake Kizai Co., Ltd.,) was printed on the entire surface of a water-cleaned substrate 2 by screen printing. Subsequently, a photo mask having a predetermined pattern was used to expose and develop the photo paste to form a precursor of a black matrix 3. The predetermined pattern refers to a pattern having a matrix-shaped aperture portion corresponding to a position of arranging a light emitting member 4. The pitch of the aperture portion was 210 μm in the X direction in the figure and 630 μm in the Y direction in the figure. The size the aperture portion was 90 μm in the X direction in the figure and 220 μm in the Y direction in the figure. As a result, the distance between the two aperture portions adjacent in the X direction was 120 μm.

Further, a photo paste (manufactured by Noritake Kizai Co., Ltd.,) with a dispersed resistance member was printed on the entire surface of the substrate 2 by screen printing. Subsequently, a photo mask having a predetermined pattern was used to expose and develop the photo paste. Finally, the photo paste was fired at a temperature of 500° C. to remove organic components in the photo paste by burning to form a resistance layer 6 with a thickness of 12 μm. The precursor of the black matrix 3 formed by firing at the same time was formed into the black matrix 3 with a thickness of 3 μm. The predetermined pattern was, first, in the image display region 10, was a straight shape pattern with a width of 50 μm extending in the Y direction and located between apertures arranged in the X direction and extending in the Y direction of the black matrix 3. Further, the predetermined pattern was a straight shape pattern with a width of 210 μm extending in the X direction and located between apertures arranged in the Y direction and extending in the X direction of the black matrix 3. Then, in the peripheral region 11 of the light emitting screen 1, the resistance layer 6 extended in a direction of the outer periphery of the substrate 2 except a region forming a connection resistance and the pattern was shaped to cover the peripheral region 11. The range forming the resistance layer 6 of the peripheral region 11 was 2 mm wider than the region forming an anode 5 and a getter to be formed in a later step. Further, a connection resistance 8 was formed at the same time as the resistance layer 6. The connection resistance 8 was a straight shape pattern with a width of 50 μm extending from the common electrode 9 to the image display region 10.

Then, a photo paste (manufactured by Noritake Kizai Co., Ltd.,) with a dispersed resistance member was printed on the entire surface of the substrate 2 by screen printing. Subsequently, a photo mask having a predetermined pattern was used to expose and develop the photo paste. Finally, the photo paste was fired at a temperature of 500° C. to remove organic components in the photo paste by burning to form a resistance adjusting layer with a thickness of 15 μm. The resistance adjusting layer 7 was located on the resistance layer 6 and was a pattern substantially parallel to each other extending in the Y direction.

Then, as the light emitting member 4, a paste with dispersed P22 phosphors for use in the CRT field was used to sieve print phosphors by screen printing according to apertures of the black matrix 3. According to the present embodiment, three color RGB phosphors were applied differently so as to make a color display. Each phosphor had a film thickness of 12 μm. The three color phosphors were dried at a temperature of 120° C. after printing. The drying may be performed for each color or all three colors at once. Further, a water solution containing alkali-silicates acting later as a binding member, namely, a so-called water glass, was sprayed and applied.

Then, an acrylic emulsion was poured and printed by a screen printing plate having a plate aperture formed according to each aperture of the black matrix 3. The thickness of the acrylic emulsion was the same as that of filling the phosphor powder space with an acrylic resin.

Then, as the anode 5, an aluminum film was deposited. The aluminum film was formed such that the anode 5 had a film thickness of 120 nm. Subsequently, the aluminum film was heated at a temperature of 450° C. to decompose and remove the acrylic resin. Note that a getter is formed on the anode 5 under a vacuum state in a subsequent paneling step. The getter has a thickness of about 50 nm.

Note that the face plate 1 has a high voltage introduction terminal passing through a through-hole of the face plate 1. The high voltage introduction terminal (unillustrated) is connected to an end portion of the common electrode 9 and the peripheral region 11.

The face plate 1 fabricated in this manner was used with a combination of the rear plate 21, the outer frame 32, and the conductive spacer 31 to fabricate the image display apparatus 41 illustrated in FIG. 3, and then discharge damage was evaluated. An increase in voltage applied to the anode 5 up to a maximum of 13 kV did not cause abnormal discharge due to unnecessary charging of the peripheral region 11. Further, even a forced discharge did not cause disconnection between the resistance layer 6 and the anode 5 in the peripheral region 11. Thus, the discharge current was suppressed up to about 0.5 A.

Example 2

The light emitting screen of the second example was the same as that of the first example except that the resistance layer 6 of the peripheral region 11 was changed to have a plurality of apertures (see FIGS. 5A to 5C). In comparison with the first example, the second example further suppressed the discharge current occurring at discharge by dividing the anode 5 of the peripheral region 11 into a larger number of anodes by the resistance layer 6.

Example 3

The light emitting screen of the third example was the same as that of the first example except that the peripheral region 11 further includes the resistance adjusting layer 7 (see FIGS. 6A to 6C). In comparison with the first example and the second example, in the third example, the resistance adjusting layer 7 is formed on the resistance layer 6 to support both the electrical connection of the anode 5 between the image display region 10 and the peripheral region 11; and the disconnection between the plurality of divided anodes 5 in the peripheral region 11.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-156929, filed Jul. 9, 2010, which is hereby incorporated by reference herein in its entirety.

What is claimed is:

1. A method of manufacturing a light emitting screen comprising:

a first step for providing a resistance layer having a plurality of apertures arranged in a lattice pattern and having light emitting members each arranged in each of the apertures, on a substrate having an image display region and a peripheral region at an outer periphery of the image display region, such that the resistance layer extends from the image display region to the peripheral region, and such that the plurality of apertures are arranged in the image display region;

a second step for providing a resistance adjusting layer having a resistance value larger than that of the resistance layer, on the resistance layer, to divide the image display region and the peripheral region into a plurality of segments; and a third step for forming a film of an electroconductive layer to cover the resistance layer and the light emitting member positioned in the segments.

2. The method according to claim 1, wherein, during the third step, the film of the electroconductive layer is formed in whole of a region inside of an outer edge of the resistance layer.

3. The method according to claim 2, wherein, during the first step, the resistance layer is formed to have the plurality of apertures also in the peripheral region.

4. The method according to claim 2, wherein, during the second step, the resistance adjusting layer is formed to divide the peripheral region into a plurality of regions.

5. A light emitting screen comprising:

a substrate having an image display region and a peripheral region at an outer periphery of the image display region;

a resistance layer having a plurality of apertures arranged in a lattice pattern in the image display region, and extending from the image display region to the peripheral region on the substrate;

light emitting members each arranged in each of the apertures;

a resistance adjusting layer having a resistance value larger than that of the resistance layer, on the resistance layer, to divide the image display region and the peripheral region into a plurality of segments; and an electroconductive layer to cover the resistance layer positioned in the segments.

6. The light emitting screen according to claim 5, wherein, the resistance layer has the plurality of apertures also in the peripheral region, and the electroconductive layer is formed in the plurality of apertures of the peripheral region.

7. The light emitting screen according to claim 5, wherein, the resistance adjusting layer is arranged to divide the peripheral region into a plurality of regions, and the electroconductive layer is arranged on the resistance layer in the segment divided by the resistance adjusting layer.

* * * * *